US006064852A

United States Patent [19]

Maekawa

[11] Patent Number: 6,064,852

[45] Date of Patent: May 16, 2000

[54] ELECTROPHOTOGRAPHIC PRINTER

[75] Inventor: Masanori Maekawa, Tokyo, Japan

[73] Assignee: Oki Data Corporation, Tokyo, Japan

[21] Appl. No.: 09/321,251

[22] Filed: May 27, 1999

[30] Foreign Application Priority Data

May 29, 1998 [JP] Japan ..... 10-149357

[51] Int. Cl.[7] ..... G03G 15/00

[52] U.S. Cl. ..... 399/397; 399/400

[58] Field of Search ..... 399/388, 397, 399/400

[56] References Cited

U.S. PATENT DOCUMENTS 4,355,881 10/1982 Tarumi et al. ..... 399/322

5,771,434 9/1998 Hokari ..... 399/400

*Primary Examiner*—Arthur T. Grimley

*Assistant Examiner*—Greg Moldafsky

*Attorney, Agent, or Firm*—Akin, Gump, Strauss, Hauer & Feld, L.L.P.

[57] ABSTRACT

A guide member is disposed between a transferring section and a fixing section. The guide member has an upstream end and a downstream end with respect to the direction of travel of the recording medium. First and second guide members define a path therebetween in which the recording medium passes to the fixing section. The first guide member is formed with a plurality of ribs formed at intervals and aligned in a direction either transverse or parallel to the direction of travel of the recording medium. The ribs extend substantially from the upstream end to the downstream end and increase in height from the surface of each guide as the downstream end is approached and guide a leading end of the recording medium. The ribs may extent progressively outwardly as the downstream end is approached. The first guide member is supported so that it is pivotal on an axis perpendicular to the direction of travel of the recording medium. The first guide member can be moved between an operative and a non-operative position. The first guide member can receive a voltage of the same polarity as the toner image.

4 Claims, 8 Drawing Sheets

ELECTROPHOTOGRAPHIC PRINTER

FIELD OF THE INVENTION

The present invention relates to an electrophotographic printer.

DESCRIPTION OF THE RELATED ART

FIG. 11 illustrates a conventional electrophotographic printer that performs the steps of charging, exposing, developing, transferring, and fixing. A charging unit 51 uniformly chargers a surface of a photoconductive drum 12. An exposing unit 55 illuminates the charged surface of the photoconductive drum 12 to form an electrostatic latent image. The electrostatic latent image is developed with toner by a developing roller 52 into a toner image. Then, the toner image is transferred to a recording medium. The toner image is subsequently fixed by a fixing unit 56. Arrows A show various, possible paths of the recording medium when it travels from the image forming unit 11 to the fixing unit 56.

The fixing unit 56 includes a heat roller 14 and a pressure roller 22. The heat roller 14 incorporates a halogen lamp 15 therein and rotates in pressure contact with the pressure roller 22. A separator tongue 17 is disposed downstream of the fixing unit 56 with respect to the direction of travel of the recording medium. The separator tongue 17 engages the surface of the heat roller 14 to separate the recording medium from the surface of the heat roller 22.

The pressure roller 22 is rotatably supported at longitudinal ends thereof by bearings 23. There is provided a spring 24 between the bearing 23 and the frame 21 and the spring 24 urges the pressure roller 22 against the heat roller 14. The recording medium having a toner image transferred thereto is pulled in between the heat roller 14 and the pressure roller 22. Then, the toner image is heated into a fixed image under a pressure applied by the pressure roller 22.

FIG. 12 illustrates the possible paths of a recording medium when printing on a curved recording medium.

When printing on an inwardly curved (i.e., toward the guide 21*a*) surface of a recording medium, the leading end of the recording medium will not slide on the guide 21*a*. As a result, the leading end of the recording medium will not be properly fed between the heat roller 14 and the pressure roller 22, but abuts, for example, the frame 21*b*. Such an improper feed of the recording medium causes the toner image on the recording medium to be scratched, and causes the recording medium to be folded or jammed.

Occasionally, a printing is performed on one side of a recording medium and subsequently on the other side. A recording medium is inwardly curved or outwardly (i.e., away from the guide 21*a*) curved after a toner image has been fixed thereto, depending on the type of the recording medium. If a subsequent printing is performed on an outwardly curved surface (i.e., a previously printed image is on an inwardly curved surface), the recording medium is allowed to travel with its leading end sliding on the guide 21*a* as depicted by arrow A of FIG. 11. However, if the subsequent printing is performed on an inwardly curved surface, the recording medium will turn up as shown by arrows C of FIG. 12, with the result that the recording medium is not allowed to travel with its leading end sliding on the guide 21*a*. As a result, the toner image before fixing may be rubbed by surroundings, resulting in deteriorated image quality, folded recording medium, or jamming of recording medium.

SUMMARY OF THE INVENTION

The present invention was made to solve the aforementioned drawbacks of the conventional medium-transporting device.

An object of the present invention is to provide an electrophotographic printer that is free from problems such as a poor image quality and the folding and jamming of recording medium.

A transferring section transfers a toner image from a photoconductive drum to a recording medium. The recording medium is guided by a guide member disposed between the transferring section and the fixing section. The recording medium is then fed to a fixing section which in turn fixes the toner image on the recording medium. The guide member having an upstream end and a downstream end with respect to a direction of travel of the recording medium. The guide member has opposed surfaces between which the recording medium is guided toward the fixing section.

The guide member has a plurality of ribs formed at intervals and aligned in a direction transverse to the direction of travel of the recording medium. The ribs extend substantially in a direction from the upstream end to the downstream end and are increasingly high from the surface of the guide as the downstream end is approached.

The ribs may extend progressively outwardly as the downstream end is approached.

The opposed surfaces include an upper surface and a lower surface that define a path therebetween in which the recording medium passes to the fixing section. The upper surface is supported so that the upper surface is allowed to pivot about an axis perpendicular to the direction of travel of the recording medium.

A voltage of the same polarity as the toner image may be applied to the guide member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE INVENTION

Figure 1:
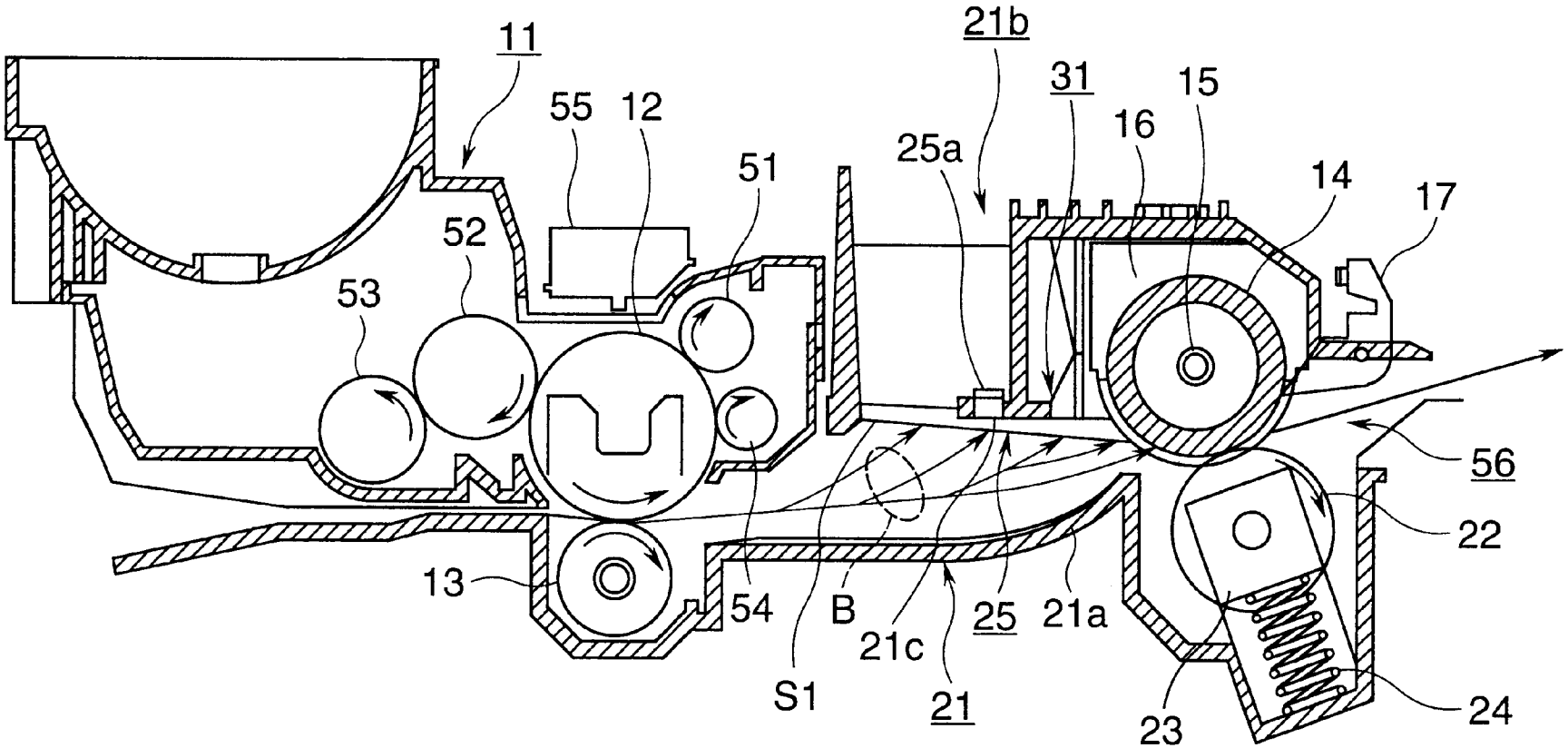
FIG. 1 illustrates the path of a recording medium according to a first embodiment.

Preferred embodiments of the present invention will be described in detail with reference to the accompanying drawings.

Elements of the same construction have been given the same reference numerals throughout the embodiments and the description thereof is omitted.

First Embodiment

<Construction>

FIG. 1 illustrates the path of a recording medium according to a first embodiment.

Referring to FIGS. 1, an image forming unit 11 is detachably mounted on a frame 21 of an electrophotographic printer. The image forming unit 11 includes a photoconductive drum 12 rotatably mounted and driven in rotation by a drive source, not shown. A charging roller 51, developing roller 52 and cleaning roller 54 are disposed such that they rotate in contact with the photoconductive drum 12. The developing roller 52 is rotatably assembled in contact with a toner-supplying roller 53.

Rotatably disposed under the image forming unit 11 is a transfer roller 13 in contact with the photoconductive drum 12. The photoconductive drum 12 has a drum gear, not shown, mounted to one longitudinal end thereof. The drum gear is in mesh with a transfer roller gear, not shown, so that the photoconductive drum 12 operatively rotates together with the transfer roller 13. Disposed above the image forming unit 11 is an exposing unit 55 such as an LED head.

The charging roller 51 uniformly charges the surface of the photoconductive drum 12, and the exposing unit 55 illuminates the charged surface in accordance with print data to form an electrostatic latent image on the photoconductive drum 12. The latent image is developed into a toner image by the developing roller 52. The toner image is then transferred to a recording medium such as paper, not shown, by the transfer roller 13.

Arrows B show various, possible paths of the recording medium. The recording medium having the toner image transferred thereto is advanced to the fixing unit 56 which in turn fixes the toner image into a permanent print.

The fixing unit 56 will now be described.

The fixing unit 56 includes a heat roller 14 rotatably supported by a wall 16, and a pressure roller 22 rotatably supported in pressure contact with the heat roller 14. The heat roller 14 incorporates a halogen lamp 15 therein. The heat roller 14 and pressure roller 22 are accommodated in a fixing unit frame 21*b*. The fixing unit frame 21*b* is secured to a main frame, not shown, by bolts.

The pressure roller 22 is rotatably supported at both longitudinal ends thereof by bearings 23. Springs 24 are disposed between the bearings 23 and the frame 21 so as to urge the pressure roller 22 against the heat roller 14. The recording medium having the toner image transferred thereon is pulled in between the heat roller 14 and pressure roller 22. The toner is fused by the heat roller 14 and pressed by the pressure roller 22 against the recording medium.

The toner image transferred to the recording medium adheres to the recording medium only by the Coulomb force and the adhesion of the toner image is very weak. Therefore, the elements of the image forming unit 11 are carefully arranged not to scratch or rub the toner image on the recording medium. The recording medium, discharged from between the photoconductive drum 12 and transfer roller 13, is advanced with a leading end thereof rubbing a guide 21*a* that extends between the image forming unit 11 and the fixing unit 56.

Figure 2:
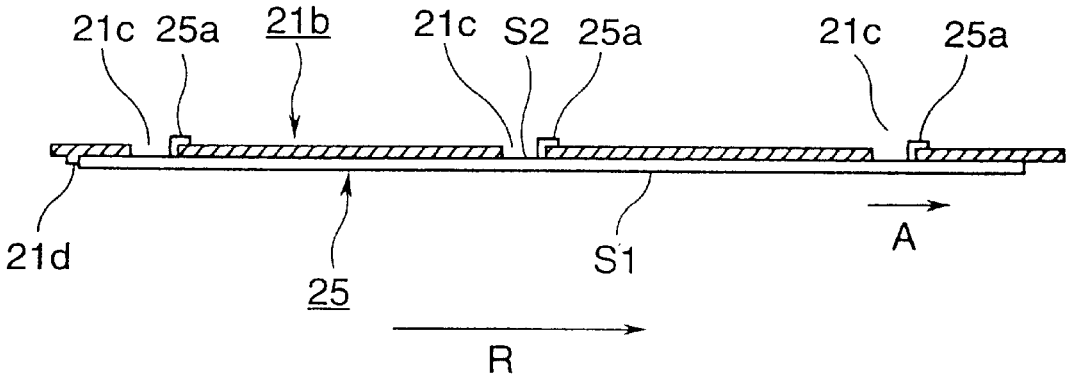
FIG. 2 is an enlarged side view of a guide assembled to a frame.

FIG. 2 is an enlarged side view of a guide 25 assembled to the frame.

One side of the guide 25 is a flat surface S1 that faces the recording medium and the other side of the guide 25 has L shaped projections 25*a* (FIG. 2). The guide 25 is attached to an underside of the frame 21*b* with the flat surface S1 facing the guide 21*a*. The frame 21*b* is formed with holes 21*c* therein, through which the L shaped projections 25*a* of the frame 21*b* extend upon assembling the guide 25 to the frame 21*b*.

With the surface S1 facing the path R of the recording medium, the guide 25 is first placed on the frame 21*b* so that the projections 25*a* are inserted into the holes 21*c*. Then, the guide 25 is moved in a direction shown by arrow A till the projections 25*a* engage the edges defining the holes 21*c*, thereby firmly assembling the guide 25 to the frame 21*b*. The frame 21*b* is formed with a rib 21*d* thereon so that when the guide 25 is moved in the direction shown by arrow A, the rib 21*d* engages the end of the guide 25. In other words, the rib 21*d* serves to prevent pullout of the guide 25.

Once the guide 25 has been mounted to the frame 21*b*, the guide 25 extends horizontally between the image forming unit 11 and the fixing unit 56. Thus, even if the recording medium is curved upward after the toner image has been transferred to the upper surface of the recording medium, the leading end of the recording medium slides on the surface S1. The leading end of the recording medium is guided by the surface S1 and smoothly pulled in between the heat roller 14 and the pressure roller 22. Transporting the recording medium in this manner prevents the toner image on the recording medium from being scratched or rubbed by the surroundings, thereby preventing deterioration of image quality. Additional advantage is that the recording medium is prevented from being bent or being jammed.

In order to minimize the frictional resistance exerted on the leading end of the recording medium when the recording medium slides on the surface of the surface S1, the surface S1 is coated with a fluoroplastics. Alternatively, the entire guide 25 may be made of fluoroplastics.

Second embodiment

Figure 3:
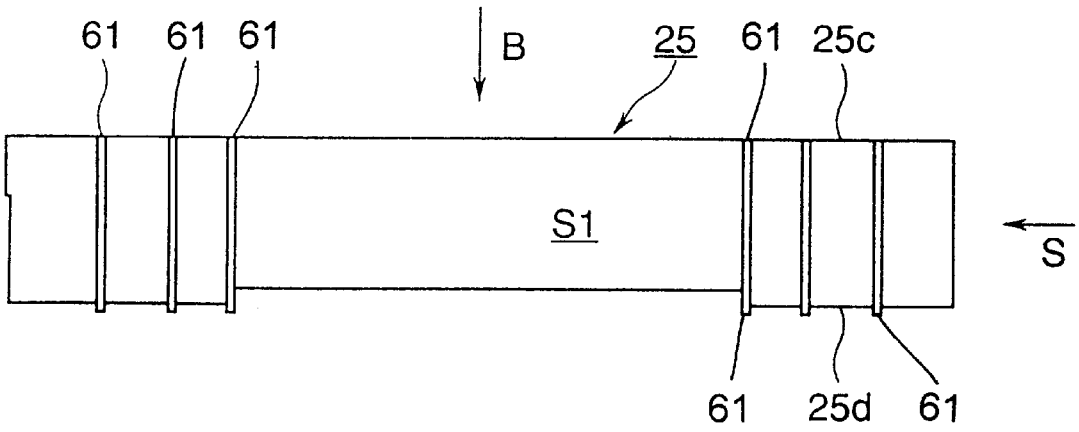
FIG. 3 illustrates the guide surface of a guide according to a second embodiment.

FIG. 3 illustrates the guide surface of a guide according to a second embodiment.

Figure 4:
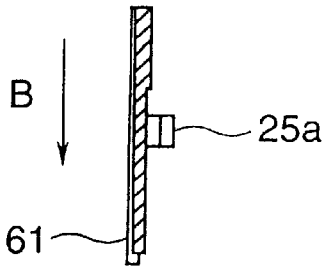
FIG. 4 is a side view of the guide of FIG. 3 as seen in a direction shown by arrow S of FIG. 3.

FIG. 4 is a side view of the guide of FIG. 3 as seen in a direction shown by arrow S.

The guide 25 is formed with a plurality of ribs 61 thereon which are aligned in a direction transverse to the direction (arrow B) of travel of the recording medium. Each of the ribs 61. extends in directions parallel to the direction of travel of the recording medium. The ribs extend from an upstream end 25*c* to a downstream end 25*d*. The ribs 61 are increasingly high from the surface of the guide 25 as the downstream end 25*d* of the guide 25 with respect to the direction shown by arrow B is approached.

Therefore, if the recording medium is curved upward after a toner image has been transferred to the upper surface of the recording medium, the ribs 61 guide the leading end of the recording medium with least frictional resistance. As a result, the recording medium can be smoothly fed to the fixing unit 56 (FIG. 1).

Third embodiment

Figure 5:
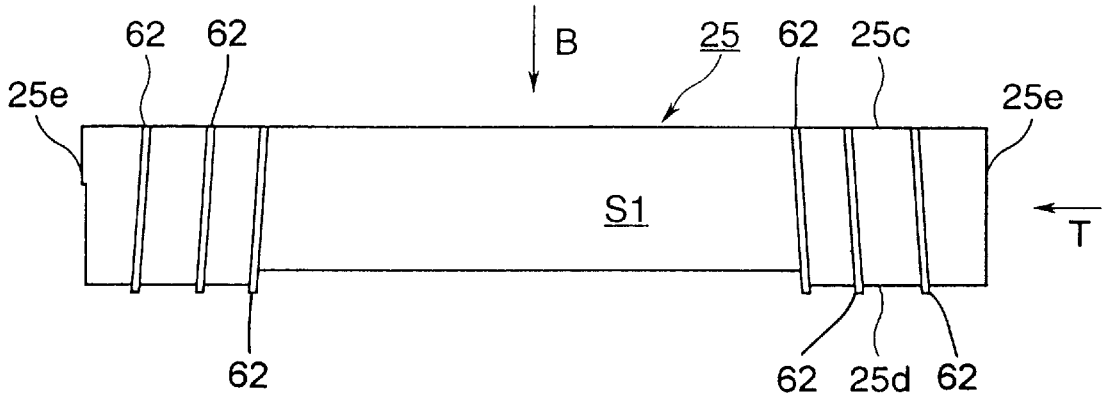
FIG. 5 illustrates the guide surface of a guide according to a third embodiment.

FIG. 5 illustrates the guide surface of a guide according to a third embodiment.

Figure 6:
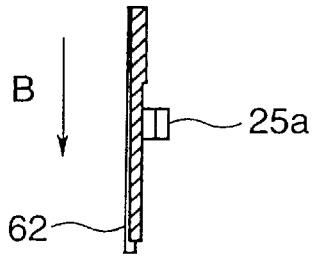
FIG. 6 is a side view of the guide of FIG. 5 as seen in a direction shown by arrow S of FIG. 5.

FIG. 6 is a side view of the guide according to the third embodiment as seen in a direction shown by arrow T of FIG. 5.

Figure 7:
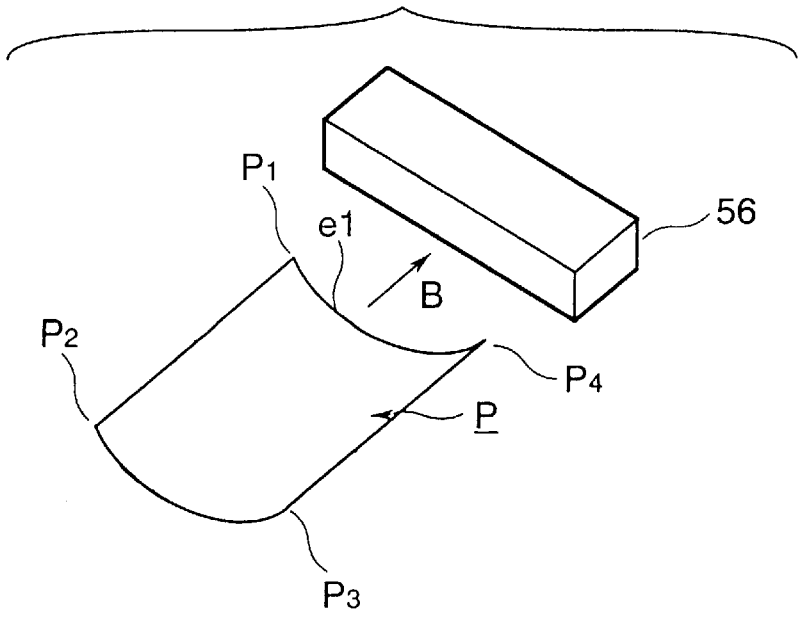
FIG. 7 is a perspective view of a curved recording medium which is about to enter a fixing unit.

FIG. 7 is a perspective view of a curved recording medium which is about to enter a fixing unit.

The guide 25 is provided with a plurality of ribs 62 formed thereon. The ribs 62 are aligned in a direction transverse to the direction (arrow B) of travel of the recording medium P. The ribs 62 extend substantially in the direction of travel of the recording medium. As the downstream end of the recording medium with respect to the direction of the recording medium P is approached, the ribs 62 are progressively close to lateral edges 25*e* of the guide 25 and are increasingly high from the surface of the guide 25.

Figure 9:
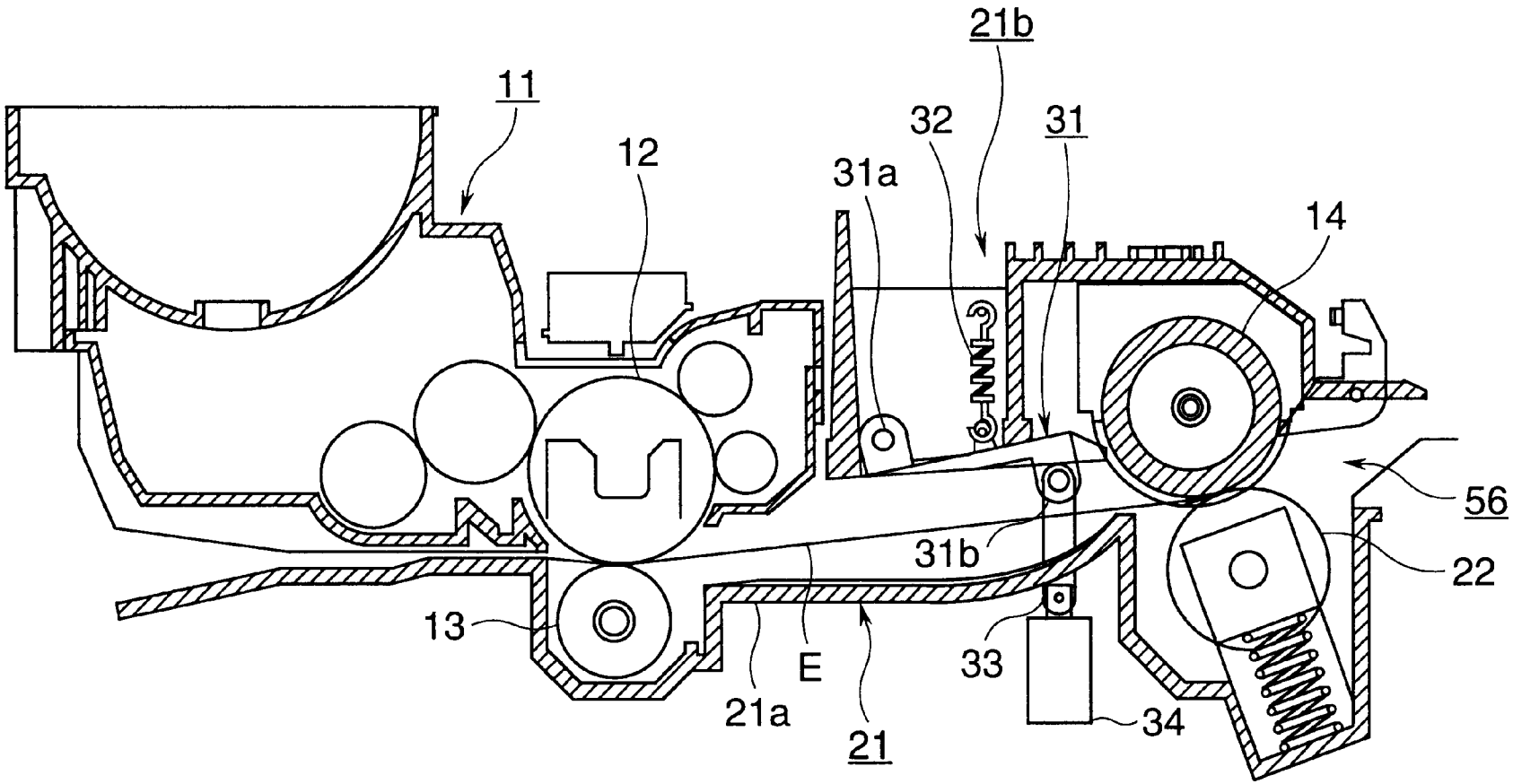
FIG. 9 illustrates the guide of FIG. 8 at a non-operative position.

As shown in FIG. 9, if the recording medium P is curved such that four corners P1–P4 of the recording medium P are warped upward after a toner image has been transferred to the upper surface of the recording medium P, the ribs 62 guide the leading end e1 of the recording medium P, straightening the widthwise curve of the recording medium P as well as minimizing the frictional resistance to which the recording medium is subjected. As a result, the recording medium P can be smoothly fed to the fixing unit 56.

Fourth embodiment

Figure 8:
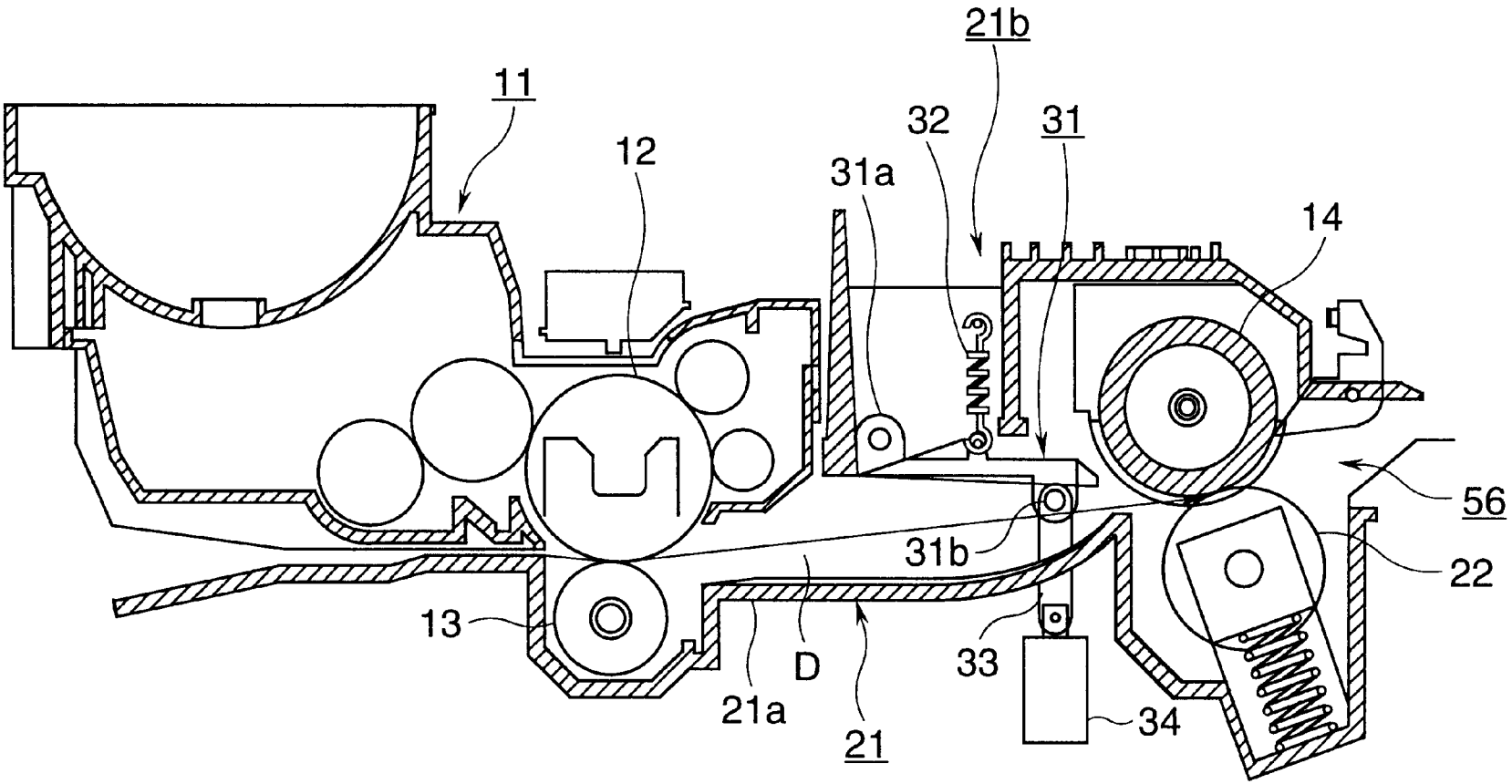
FIG. 8 illustrates a guide according to a fourth embodiment, the guide being at an operative position.

FIG. 8 illustrates a guide according to a fourth embodiment at an operative position.

FIG. 9 illustrates the guide at a non-operative position.

A guide 31 is pivotally mounted to a lower end of a frame 21*b* to oppose a guide 21*a*. The guide 31 is switched between an operative position and non-operative position. The guide 31 has posts 31*a* located at an upstream end of the guide 31 with respect to the direction of travel of the recording medium. The posts 31*a* are aligned in a direction transverse to the direction of travel of the recording medium and positioned at opposed lateral ends of the path of the recording medium. The posts 31*a* extend through holes, not shown, formed in the frame 21 so that the guide 31 is pivotally supported. A spring 32 is mounted between the frame 21.b and a substantial middle of the guide 31 and urges the guide 31 upwardly. The guide 31 has posts 31*b* formed at a downstream end thereof with respect to the direction of travel of the recording medium. The guide 31 is coupled through a solenoid lever 33 to a solenoid 34.

When the leading end of the recording medium passes between the photoconductive drum 12 and transfer roller 13, the solenoid 34 is energized so that the guide 31 pivots clockwise to the operative position as shown in FIG. 8. Subsequently, the leading end of the recording medium is guided by the guide 31 in a direction shown by arrow D. When the leading end of the recording medium enters between the heat roller 14 and the pressure roller 22, the solenoid 34 is deenergized. Then, the urging force of the spring 32 causes the guide 31 to pivot counterclockwise to the non-operative position as shown in FIG. 9.

When the guide 31 is at the operative position, the guide 31 smoothly guides the recording medium to the fixing unit 56. When the guide 31 is at the non-operative position, the gap between the guide 31 and the recording medium is wide open so that the toner image is not rubbed by the surroundings before the recording medium reaches the fixing unit. The recording medium travels in a direction shown by arrow E. In this manner, the image quality is maintained. The guide 31 is positioned at the non-operative position when an outwardly curved recording medium is printed, and at the operative position when an inwardly curved recording medium is printed.

Fifth embodiment

Figure 10:
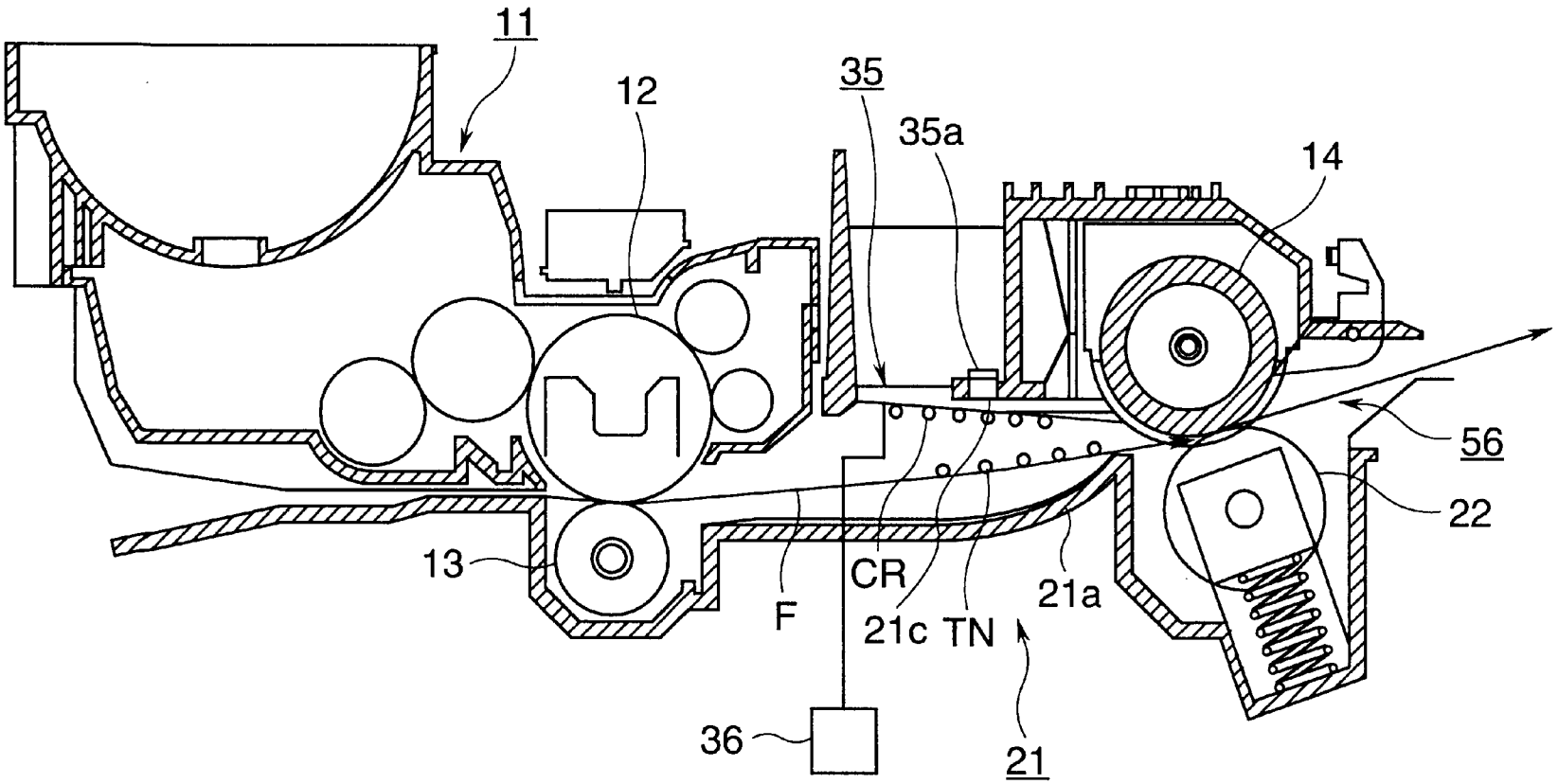
FIG. 10 illustrates an electrophotographic printer according to a fifth embodiment.
Figure 11:
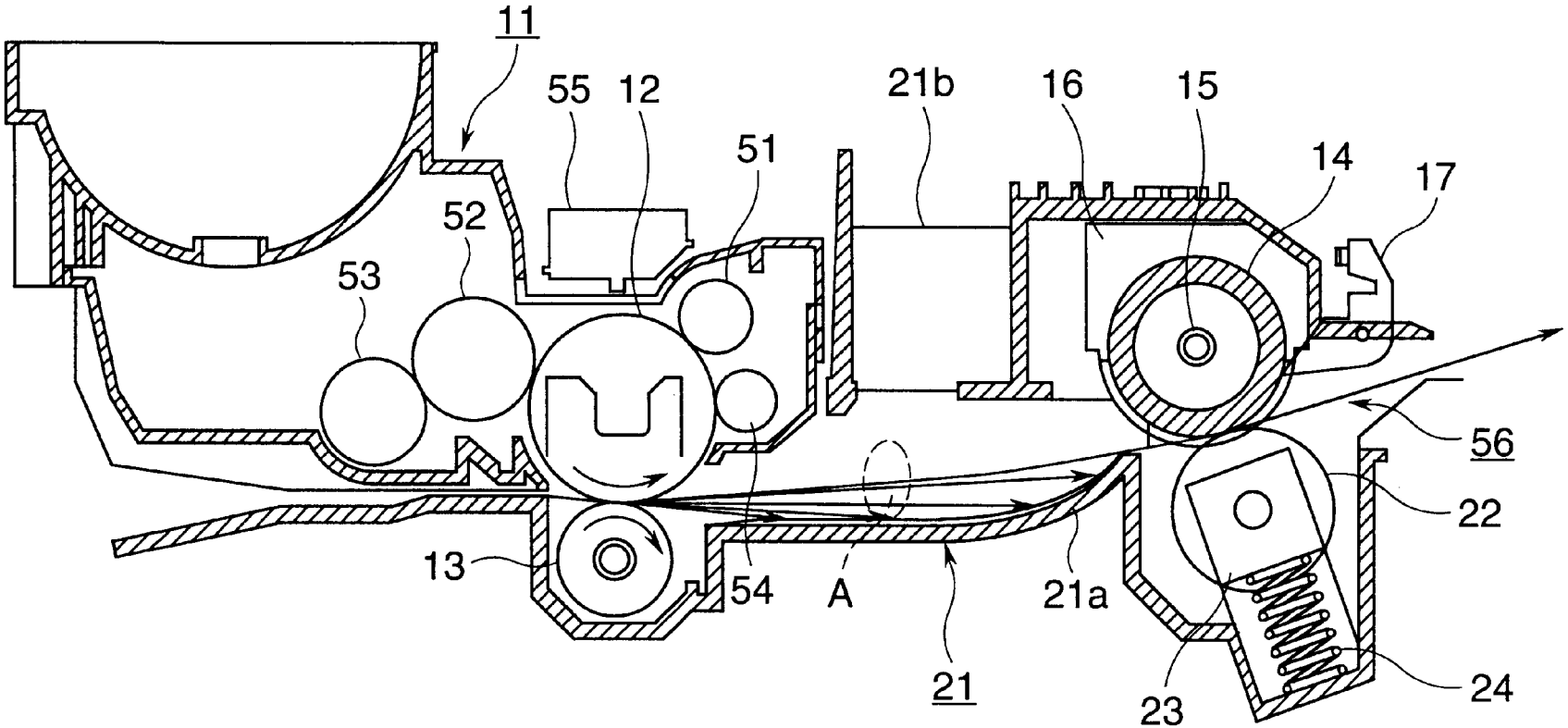
FIG.11 CONVENTIONAL ART
FIG. 11 illustrates a conventional electrophotographic printer.
Figure 12:
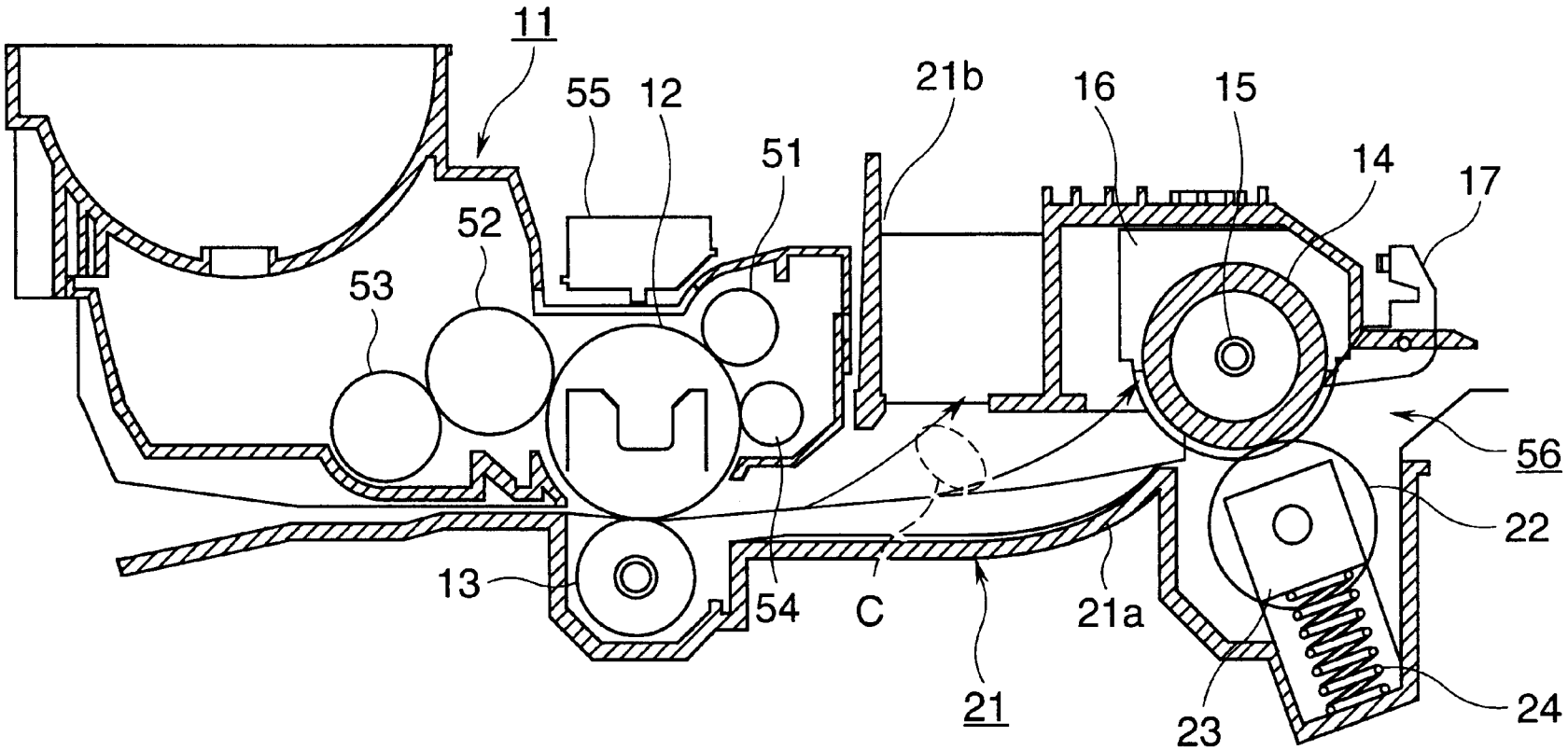
FIG.12 CONVENTIONAL ART
FIG. 12 illustrates various, possible paths of a recording medium in the conventional electrophotographic printer when printing on a curved recording medium.

FIG. 10 illustrates an electrophotographic printer according to a fifth embodiment.

A guide 35 is formed of an electrically conductive material and has projections 35*a* that engage holes 21*c* just as in the first embodiment. The guide 35 is connected to a power supply 36 and receives from the power supply 36 a voltage of the same polarity as the charged toner image transferred to the recording medium, not shown. The recording medium travels in a direction shown by arrow F.

The power supply 36 continues to apply the voltage to the guide 35 from the time the leading end of the recording medium passes between the photoconductive drum 12 and the transfer roller 13 until the leading end of the recording medium enters between the heat roller 14 and the pressure roller 22. Since the toner image TN and the voltage applied to the guide 35 are of the same polarity, charges CR stored on the guide 35 repel those of the toner image. The repellent force between the guide 35 and the toner image TN suppresses the curving of the recording medium, facilitating feeding of the recording medium to the fixing unit 56 after transferring operation as well as preventing the toner image before fixing from being damaged.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electrophotographic printer, comprising:

a transferring section which transfers a toner image from an image bearing body onto a first surface of a recording medium;

a fixing section which fixes the toner image on the first surface of the recording medium;

a first guide member extending between said transferring section and said fixing section and facing the first surface of the recording medium;

a second guide member between said transferring section and said fixing section and facing a second surface of the recording medium opposite to the first surface; and a plurality of ribs formed on the first guide member and facing the first surface of the recording medium, said ribs extending more outwardly nearer the downstream end with respect to a direction of travel of the recording medium.

2. An electrophotographic printer, comprising:

a transferring section which transfers a toner image from an image bearing body onto a first surface of a recording medium;

a fixing section which fixes the toner image on the first surface of the recording medium;

a first guide member extending between said transferring section and said fixing section and facing the first surface of the recording medium, said first guide member having a first end close to said transferring section and a second end close to said fixing section, said first guide member being rotatably supported at the first end on a shaft that extends perpendicular to a direction of travel of the recording medium; and a second guide member extending between said transferring section and said fixing section and facing a second surface of the recording medium opposite to the first surface;

wherein said first guide member and said second guide member define a transport path therebetween through which the recording medium travels from said transferring section to said fixing section, said first guide member being selectively rotatable to a first position where the second end of said first guide member is closer to the second guide member to make the transport path narrow, and to a second position where the second end of said first guide member is away from said second guide member to make the transport path wide.

3. The electrophotographic printer according to claim 2, further comprising a solenoid connected to said first guide member;

wherein said first guide member is urged to the second position and is driven by said solenoid to rotate to the first position when said solenoid is energized.

4. An electrophotographic printer, comprising:

a transferring section which transfers a toner image from ar image bearing body onto a first surface of a recording medium;

a fixing section which fixes the toner image on the first surface of the recording medium;

a first guide member extending between said transferring section and said fixing section and facing the first surface of the recording medium, said first guide member having a first end close to said transferring section and a second end close to said fixing section, said first guide member being rotatably supported at the first end on a shaft that extends perpendicular to a direction of travel of the recording medium;

a second guide member extending between said transferring section and said fixing section and facing a second surface of the recording medium opposite to the first surface; and a power supply connected to said first guide member, said power supply supplying a voltage of the same polarity as toner of the toner image.

* * * * *